United States Patent [19]

Best et al.

[11] 4,444,034

[45] Apr. 24, 1984

[54] PULL-RESISTANT LOCK CORE

[75] Inventors: Walter E. Best; William R. Foshee, both of Indianapolis, Ind.

[73] Assignee: Best Lock Corporation, Indianapolis, Ind.

[21] Appl. No.: 284,082

[22] Filed: Jul. 16, 1981

[51] Int. Cl.[3] ..... E05B 9/04; E05B 27/04

[52] U.S. Cl. ..... 70/369; 70/371; 70/373

[58] Field of Search ..... 70/369, 367, 337, 371, 70/372, 373, 375, 379 A, 379 R, 380

[56] References Cited

U.S. PATENT DOCUMENTS

| | | | |
|---|---|---|---|
| 1,384,022 | 7/1921 | Best . | |
| 1,656,854 | 1/1928 | Best | 70/369 |
| 2,145,085 | 1/1939 | Heyer | 70/421 |
| 2,418,080 | 3/1947 | Ledin et al. | 70/369 |
| 3,206,958 | 9/1965 | Best | 70/373 |
| 3,603,123 | 9/1971 | Best | 70/369 X |
| 3,667,264 | 6/1972 | Surko, Jr. et al. | 70/369 |
| 3,713,310 | 1/1973 | Surko, Jr. | 70/337 X |
| 3,713,311 | 1/1973 | Oliver et al. | 70/369 |
| 4,098,103 | 7/1978 | Raskevicius | 70/373 X |
| 4,195,504 | 4/1980 | Foshee | 70/369 |
| 4,294,093 | 10/1981 | Best et al. | 70/369 |
| 4,328,690 | 5/1982 | Oliver | 70/369 |

FOREIGN PATENT DOCUMENTS

| | | | |
|---|---|---|---|
| 537277 | 6/1941 | United Kingdom | 70/369 |

*Primary Examiner*—Gary L. Smith
*Assistant Examiner*—Lloyd A. Gall
*Attorney, Agent, or Firm*—Barnes & Thornburg

[57] ABSTRACT

A key-removable core of figure-8 cross section having increased pull resistance. A recess is formed in the pin tumbler lobe of the core body and opens both outward through the side of the body and downward toward the key plug lobe. A control sleeve in the key plug lobe has a wide longitudinal rib which carries a core-retaining lug which extends from such rib both circumferentially of the sleeve and radially outward thereof into said recess so as to substantially increase the effective cross section of the lug for increased pull resistance. Cores with thus enlarged lugs may be used in standard receptacles. Also, the plug may be in two segments providing two end faces for retaining engagement with two shoulders in the wall of the receptacle. The lug may be further enlarged by increasing its length, and the increased length accommodated by forming the core chamber with deeper clearances and wider lug-engaging shoulders.

23 Claims, 22 Drawing Figures

PULL-RESISTANT LOCK CORE

This invention relates to a pin tumbler lock mechanism including a key-removable core having improved pull resistance.

Pin tumbler lock mechanisms have been on the market for more than fifty years in which a key-removable lock core of figure-8 cross section is mounted in a cylinder or padlock or other receptacle having a core-receiving chamber of complementary figure-8 shape. Such mechanisms, substantially as shown in FIGS. 1–9 of U.S. Pat. No. 3,206,959, of Sept. 21, 1965, have a number of advantages. The core is easily and quickly interchangeable by using a special control key to remove the existing core and to insert a different core to change the lock so as to require the use of a different operating key. The cores are adapted for use and are used in elaborate lock systems providing several levels of master keying, for example, a submaster key for a department in a building, a master key for the entire building, and a grand master key for an entire system. Administration and maintenance of lock installations, and especially those in such elaborate systems, is facilitated by the ability to interchange new or replacement standard cores in the standard receptacles of locks which may have been installed at various times over a period of many years. Such interchange may be for maintenance, for modifying the master keying system as organizational changes occur, for enhancing security, or for various other purposes. Security is improved, for example, by the practice of changing the locks of hotel room doors after guests have departed so that new guests will have keys different from those of departing guests.

The standard core comprises a core body of figure-8 cross section having a key plug lobe and a pin tumbler lobe in parallel intersecting relation and defining V-shaped grooves therebetween at the sides of the core. A key plug is rotatable on an axis in the key plug lobe, and a control sleeve is mounted for limited rotation within the key plug lobe and surrounds the key plug. Such sleeve includes a wide longitudinal segment or rib, and a series of pin tumbler barrels are formed in the pin tumbler lobe and extend through the sleeve rib and into the key plug. The cylindrical interface between the inner surface of the sleeve and the outer surface of the key plug define an operating shear line across the pin tumbler barrels, and such operating shear line lies in and defines a geometric surface of revolution. For convenient reference, such geometric cylindrical surface is here referred to as the "operating shear cylinder." The sleeve rib also has an outer cylindrical surface in interface relation with a cylindrical surface formed in the upper lobe of the core body, and such interface defines a control shear line across the pin tumbler barrels. Such control shear line lies in and defines a geometric cylindrical surface of revolution along which the interfacing surfaces of the sleeve and body extend, and for convenience, such geometric cylindrical surface of revolution is here referred to as the "control shear cylinder."

In the standard mechanism, the core is retained in the receptacle by a retainer lug which is integral with the sleeve and projects circumferentially of the sleeve from the rear portion of the thick rib, wholly between the operating shear cylinder at the inner face of the sleeve and the operating shear cylinder at the outer face of the thick rib. The retainer lug projects laterally from the core in a side groove between the two lobes of the core and terminates at or inside the plane tangent to the two lobes. In its normal core-retaining position, the lug is engaged behind a shoulder on the side rib between the two lobes of the core chamber, which shoulder is formed by milling away a rear portion of such side rib. In the standard practice, such milling produces a flat face in the plane tangent to the two lobes of the chamber.

In this standard construction, the retainer lug lies wholly within the control shear cylinder so that its radial thickness is limited. Also, both the retainer lug and the shoulder it engages lie inside the plane tangent to the two lobes of the core. These factors severely limit the cross-sectional areas of the lug and shoulder which are available for engagement to resist pulling on the core.

Recent methods of attack on pin tumbler locks of this general type involve the exertion of pull on the key plug, tending to pull it from the lock, either by the use of an impact hammer or by a threaded puller. Such pull tends to pull the plug from the core body, either with or without the sleeve. U.S. patent application Ser. No. 048,531, filed June 14, 1979 by the present inventors and another, now U.S. Pat. No. 4,294,093 of Oct. 13, 1981, is directed to a core construction having increased resistance to pull of the key plug from the core body. The pull exerted in such attack, however, is also exerted on the core as a whole, tending to pull the core out of the core chamber by causing failure of the retaining lug which retains the core in the chamber or failure of the shoulder and side rib of the chamber which is engaged by the lug.

It is the object of the present invention to increase the resistance of a key-removable core against pull tending to withdraw it from its receptacle, and in a preferred embodiment to do so in a core which will still fit a standard core receptacle so that it can be used in any of the many existing installations having standard receptacles. It is a further object of the invention to provide a key-removable core and core receptacle having even greater pull resistance, for use in special high-security applications. It is a further object of the invention to accomplish these results with a minimum of change from standard manufacturing practices, and while retaining the benefits provided by operating and control shear lines which both extend across all of the pin tumbler barrels of the lock core.

In accordance with the present invention, the standard core is modified by forming in the control shear cylinder face of the core body a recess which extends radially from the rotation axis of the sleeve beyond such face, and which opens both downward through such face toward the key plug lobe and laterally through the side face of the core body above the control shear cylinder; and by enlarging the retaining lug on the core sleeve with an enlargement which extends beyond the control shear cylinder and which, in the retracted position of the lug, lies within such recess. This substantially increases the effective cross-sectional area of engagement of the lug with the retaining shoulder of a standard core chamber, and substantially increases the pull resistance of the core. The core body recess is preferably formed by cutting axially from the rear of the core body a circular bore of a diameter and in a position to form the desired size and position of the recess and to a depth corresponding to the design length of the retaining lug. (The side window of a standard core is cut in a similar manner but with a small cutter which produces no recess, so that a minimum of change in manufacturing practice is required.) To further enhance the pull resistance, the retaining lug may be formed with a notch intermediate its ends so as to provide two forward presented end faces, and by correspondingly forming the core chamber with two rearward-presented shoulders for engagement by such two end faces of the lug.

Further in accordance with the invention, the core body recess also permits the enlarged lug to be lengthened so that in projected position it extends laterally from the core a greater distance and beyond the plane tangent to the lobes of the two lobes of the core. To accommodate the extended lug, the core chamber may be formed with a side recess or recesses, beyond its tangent plane, to receive the lengthened lug. When the lug is of full axial length, without a central notch, the chamber recess may be formed either by milling from the inside or by cutting a bore axially from the rear of the core receptacle. When the lug is notched, a shoulder for the front end portion of the lug may be formed by inside milling in the chamber and that for the rear end portion may be formed by a rear axial bore.

The accompanying drawings illustrate the invention and show embodiments exemplifying the best mode of carrying out the invention as presently perceived. In such drawings.

Figure 10:
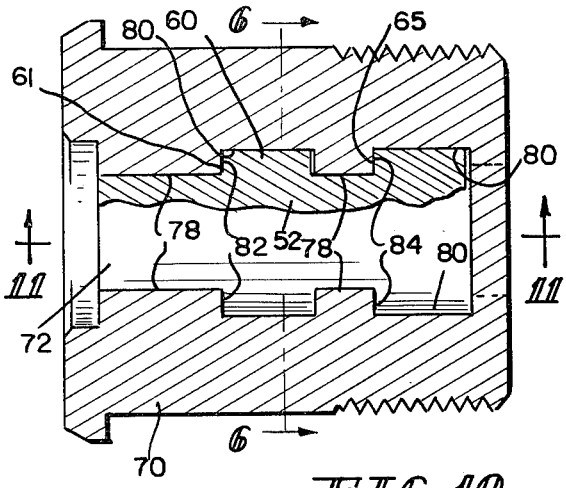
FIG. 10 is a horizontal section generally on the line 10—10 of FIG. 6 showing the interlocking engagement of the core-retaining lug in a special core chamber of an otherwise conventional lock cylinder.
Figure 11:
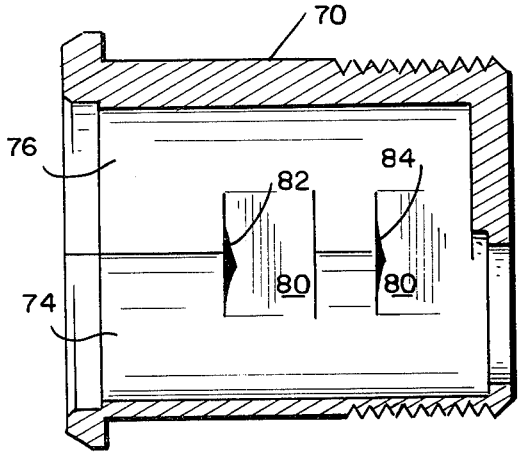
FIG. 11 is a vertical section taken on the line 11—11 of FIG. 10, with the core chamber empty so as to show the two shoulders formed in such chamber by milling side wall areas flat in the plane tangent to the two lobes of the chamber.
Figure 18:
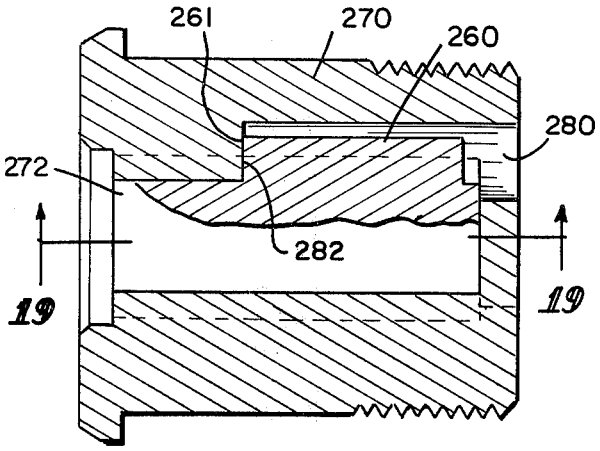
FIG. 18 is a horizontal section of a lock cylinder in which a core-receiving recess is formed by cutting a cylindrical bore from the rear of the cylinder, and showing in section a portion of an enlarged but unsegmented core-retaining lug having a single retaining face at its forward end.
Figure 19:
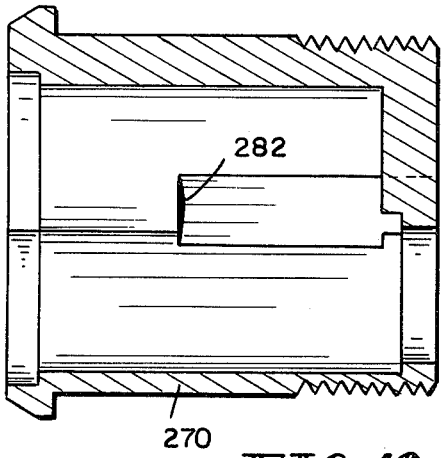
FIG. 19 is a section taken on the line 19—19 of FIG. 18 and showing the position of the shoulder formed by the axial bore from the rear.
Figure 20:
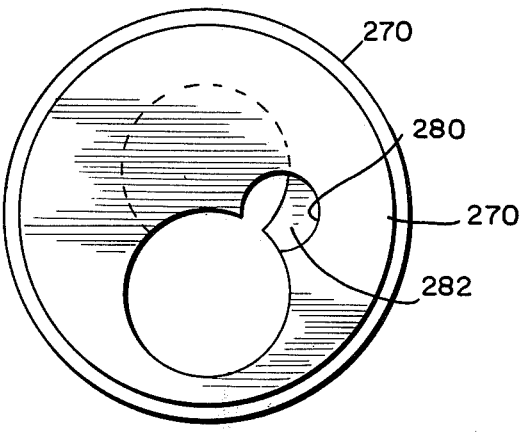
FIG. 20 is a rear elevation of the cylinder shown in FIGS. 18 and 19, showing the position of the axial bore.
Figure 21:
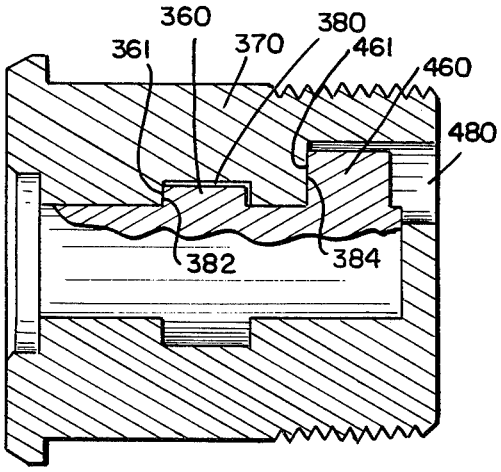
Figure 22:
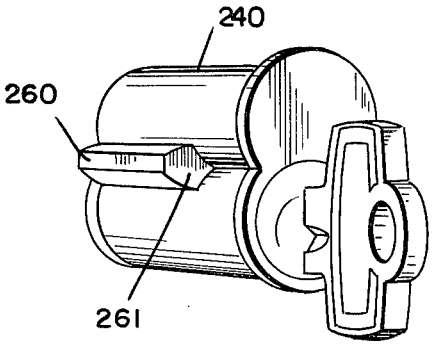

FIG. 21 is a horizontal section similar to that of FIGS. 10 and 18, showing a cylinder having a core chamber with a front lug-receiving side recess formed by flat milling the side of the chamber as in FIGS. 10 and 11, and with a rear lug-receiving side recess formed by an axial bore from the rear of the cylinder as in FIGS. 18–20; and FIG. 22 is a perspective view of a key-removable core having an enlarged but unsegmented core-retaining lug as shown fragmentally in FIG. 18.

Figure 1:
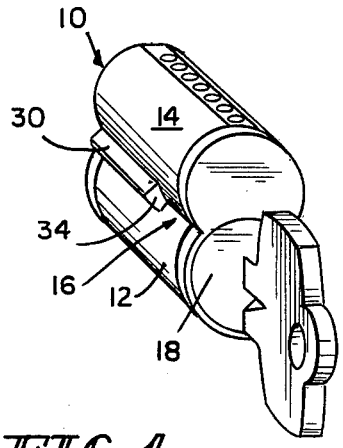
FIG. 1 is a perspective view of a standard key-removable core in accordance with the prior art.
Figure 2:
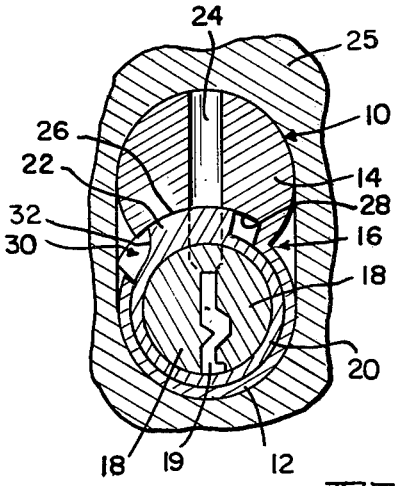
PRIOR ART FIG. 2
FIG. 2 is a cross-sectional view of the standard core of FIG. 1, shown mounted in a prior art core receptacle defining a core chamber of complementary figure-8 cross section.
Figure 8:
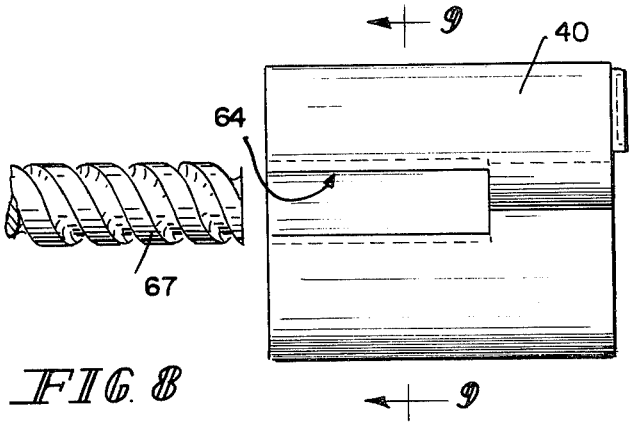
FIG. 8 is a diagrammatic view illustrating the method of forming the lug-receiving recess in the core body of FIGS. 3–7.

The standard prior art core shown in FIGS. 1 and 2 comprises a core body 10 of figure-8 cross section having a lower key plug lobe 12 and an upper pin tumbler lobe 14 in parallel intersecting relation and defining V-shaped grooves 16 between the two lobes at the sides of the core. A key plug 18 is rotatable on the axis of the key plug lobe. A control sleeve 20 is mounted in the key plug lobe surrounding the key plug and is rotatable through a limited angle about the axis of the key plug. The sleeve 20 carries a wide and thick segment or rib 22 at the top, extending the full length of the body, and a series of pin barrels 24 are formed in the pin tumbler lobe 14 and extend downward through the sleeve rib 22 and into the key plug 18. The cylindrical interface between the inner surface of the sleeve 20 and the outer surface of the key plug 18 define an operating shear line OP across the pin tumbler barrels, and such operating shear line lies in and defines a geometric surface of revolution which, for convenience, is here referred to as the "operating shear cylinder." The sleeve rib also has an outer cylindrical surface 26 in interface relation with a cylindrical surface 28 formed in the upper lobe of the core body, and such interface defines a control shear line CN across the pin tumbler barrels. Such control shear line CN lies in and defines a geometric cylindrical surface of revolution which, for convenience, is here referred to as the "control shear cylinder."

In the standard construction, the core is retained in a core receptacle 25 by a retainer lug 30 which is integral with the sleeve 20 and the wide rib 22. In practice, the rib 22 is originally formed of full width, and is cut away over its forward portion on the surface 32 to leave the lug 30 projecting circumferentially from the wide and thick segment or rib 22. A rear portion of the side wall of the core body 10 is cut away at the rear to leave a side opening through which the lug 30 projects when such lug is in its normal core-retaining position. As shown in FIG. 2, the lug 30 lies wholly within the control shear cylinder, i.e., the cylinder of the face 28 so that as the sleeve 20 is rotated from its lug-projected position shown in FIG. 2, clockwise to a lug-retracted position, the lug 30 moves clockwise within the cylinder defined by the surface 28 of the upper lobe 14 of the core body, which surface lies on and follows the geometric control shear cylinder. In the standard construction, the projected lug 30 terminates at or inside the side plane PL tangent to the lobes 12 and 14 of the core body. A standard core receptacle 25 has a core chamber of figure-8 cross section in which rear portions of the side ribs between the two lobes are milled away to form flats in the plane tangent to the two lobes of the chamber and to form rearward-presented shoulders on the ribs at the front of such flats. When a core is mounted in the chamber, its retaining lug 30 enters the space formed by such milling at the left side of the chamber, and the front end face of the lug engages behind the shoulder formed at that side of the chamber. In this standard arrangement, the lug 30 lies wholly within the control shear cylinder and terminates short of the tangent plane PL, and in consequence, its area of engagement with the receptacle shoulder is limited. The pull resistance of a core retained by such a lug is likewise limited.

Figure 3:
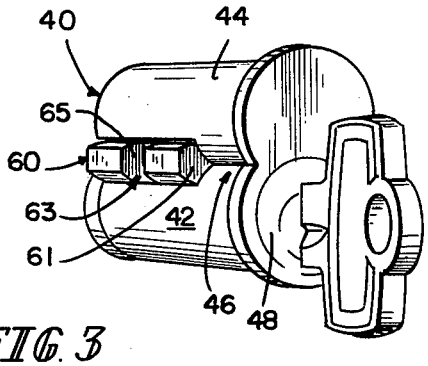
FIG. 3 is a perspective view of a key-removable core in accordance with the present invention.
Figure 5:
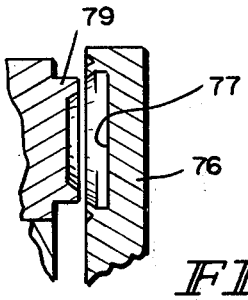
FIG. 5 is a partial sectional view illustrating the method of attaching a face plate to the core body of the core shown in FIG. 6.
Figure 4:
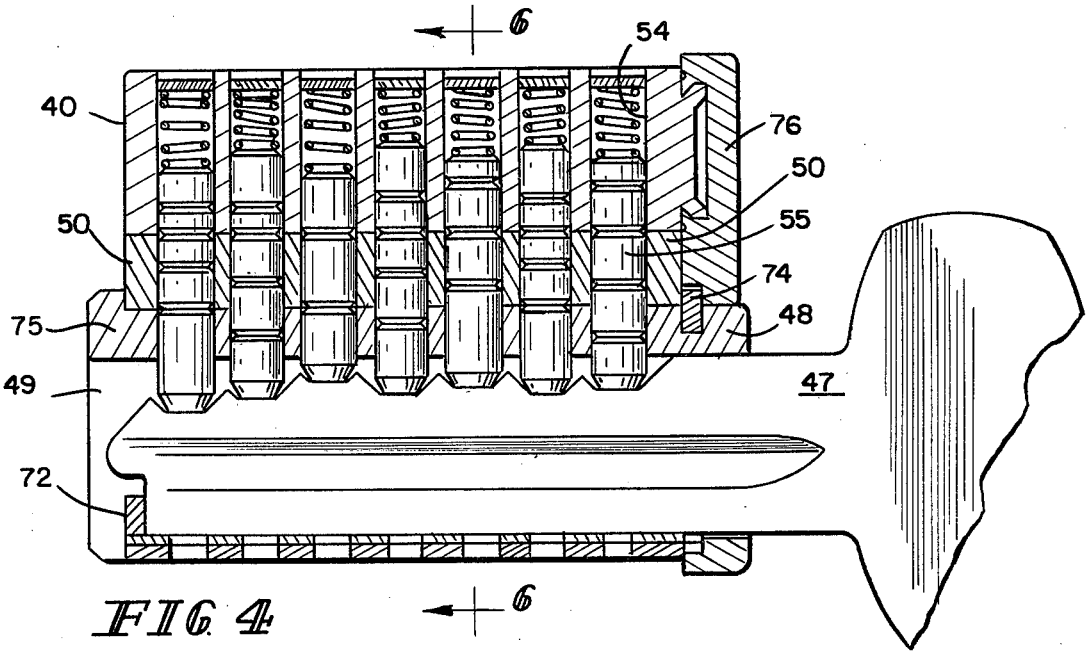
FIG. 4 is an axial section of a key-removable core as shown in FIG. 3.
Figure 6:
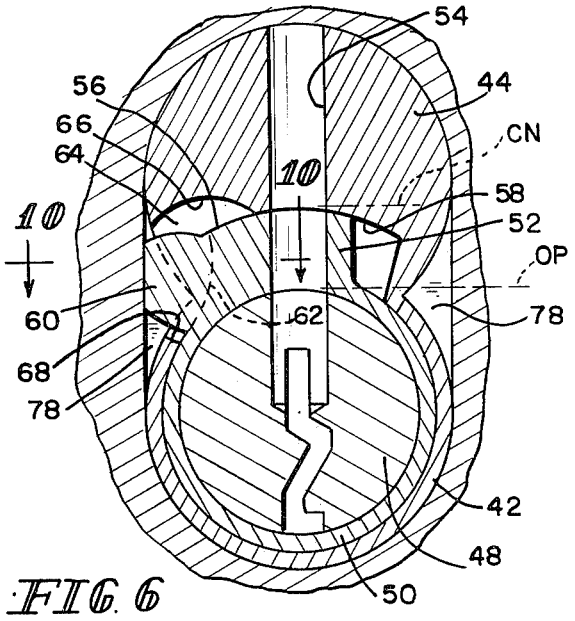
FIG. 6 is an enlarged cross-sectional view taken on the line 6—6 of FIG. 4, with the core-retaining lug in core-retaining projected position.

The core of the present invention shown in FIGS. 3–7 is of generally similar size and construction but has greatly increased pull resistance. It comprises a core body 40 of figure-8 cross section having a key plug lobe 42 and a pin tumbler lobe 44 in parallel intersecting relation and defining V-shaped grooves 46 therebetween at the sides of the core. A key plug 48 is rotatable on an axis in the key plug lobe, and a control sleeve 50 is mounted for limited rotation on the axis of the key plug lobe and surrounds the key plug 48. As shown in FIGS. 4 and 6, such sleeve 50 includes a wide longitudinal segment or rib 52 at the top, and a series of pin tumbler barrels 54 are formed in the pin tumbler lobe 44 and extend through the sleeve rib 52 and into the key plug 48. As in the standard core, the cylindrical interface between the inner surface of the sleeve and the outer surface of the key plug define an operating shear line OP across the pin tumbler barrels, and such operating shear line lies in and defines the geometric surface of revolution here defined as the "operating shear cylinder." The sleeve rib 52 also has an outer cylindrical surface 56 in interface relation with a cylindrical surface 58 formed in the upper lobe of the core body, and such interface defines a control shear line CN across the pin tumbler barrels. Such control shear line lies in and defines the geometric cylindrical surface of revolution which is here referred to as the "control shear cylinder."

As shown in FIG. 6, and as more fully shown in the co-pending application Ser. No. 048,531, filed June 14, 1979, the key plug 48 is a cylindrical plug containing a keyway 49 and having a flange 75 at its rear end bearing against the rear face of the core body 40 and sleeve 50 so as to transmit pull on that key plug to such body and sleeve. Immediately ahead of such head, the bottom of the key plug is formed with a shallow cross slot containing a key stop insert 72. Adjacent its forward end, the plug is formed with a circumferential groove containing a C-shaped retaining ring 74 which interlocks with the groove so that it cannot move to block the keyway. The retaining ring 74 is trapped in place by the face plate 76 of the core, which is applied to the assembly after the key plug and sleeve and retainer ring have been assembled to the core body 40. The face plate 76 is then assembled to the core body and secured in place in the manner indicated in FIG. 5. The face plate is formed with an undercut recess 77, and the upper lobe 44 of the core body 40 is formed with a short stud 79 shaped so as to be deformed outward into the undercut of the recess 77 when the face plate 76 is pressed against the front end of the core body.

The completed core contains stacks of pin tumblers 55 in the several pin tumbler barrels 54, as shown in FIG. 6. Each stack includes a number of segments in abutting relation, adapted to be moved by a suitable operating key to align shear faces in the tumbler stacks at the operating shear line for rotation of the key plug 48 in the usual lock-operating manner; and to be moved by a suitable control key 47 to align shear faces in the pin tumbler stacks at the control shear line, as shown, so as to permit such control key 47 to rotate the key plug 48 and sleeve 50 jointly through the limited rotation provided for the sleeve 50.

Figure 7:
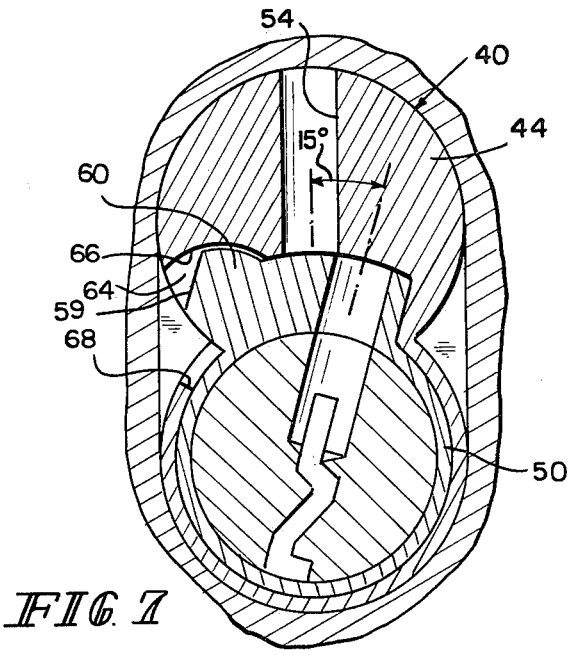
FIG. 7 is a sectional view like FIG. 6 but showing the core-retaining lug in retracted position.

In the embodiment of the present invention, shown in FIGS. 3 and 6, the wide rib 52 on the sleeve 48 carries a key-retaining lug 60 which projects through the side of the core body 40 at one of the side grooves 46 of that figure-8 shaped body. The sleeve and its rib 52 may be originally formed with a longitudinal rib having throughout its length the full cross section shown in FIG. 6, and a side portion of such rib may be cut away, over a forward portion of the sleeve, as on the line 62 shown in dotted lines in FIG. 6 so as to leave the retaining lug 60. Such lug projects from the rib 52 of the sleeve, both circumferentially of the sleeve and also radially of the sleeve so as to include a substantial enlargement which lies radially beyond the geometric control shear cylinder defined by the shear line CN and extending along the cylindrical surface 56 of the sleeve rib. Also as shown in FIG. 6, the upper lobe 44 of the core body is formed with a recess 64 into which the retaining lug 60 moves when the sleeve 48 is rotated by a control key 47 to its lug-retracting position as shown in FIG. 7. Such recess 64 is desirably defined by a cylindrical surface 66, and extends forward from the rear of the core body 44 a distance equal to the length of the retaining lug 60, as shown in FIG. 3. Such recess lies radially outward beyond the geometric control shear line cylinder, and opens both through the face 58 on the upper lobe toward the sleeve rotation axis and also through the side of the pin tumbler lobe 44 so that the retaining lug 60 can move into and out of such recess. The lug 60 desirably has an upper side face complementary to the cylindrical face of the recess 64, and may move against such recess face as a stop.

Figure 9:
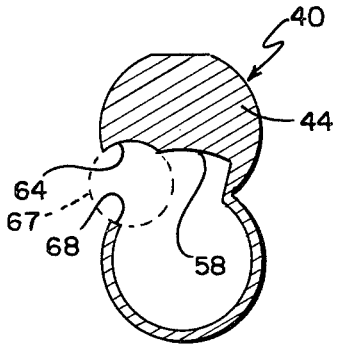
FIG. 9 is a section taken on the line 9—9 of FIG. 8 showing the position of the tool used to form the recess.

The recess 64 is desirably formed in the core body in the manner illustrated in FIGS. 8 and 9. A core body 40 originally in the form of a solid bar of the desired figure-8 cross section is bored to receive the cylindrical portion of the sleeve 48, and is then broached longitudinally to form an arcuate cavity in the upper lobe 44 defined by the cylindrical face 58. This leaves the core body with continuous side walls of the configuration shown at the right in FIG. 6. An end mill cutter 67, diagrammatically indicated in FIG. 8, is then moved through a plunge cut from the rear of the body 40, with such tool 67 positioned as shown by the dotted lines in FIG. 9, so that such tool cuts away a mid-portion of the left side wall of the core body 40, and also cuts upward into the upper lobe 44 at one side thereof to form the substantial recess 64. The cutter 67, in cutting away the side wall of the core body, leaves an edge 68 in the cylindrical wall of the lower lobe 42 of the core body, which provides clearance for the base of the retaining lug 60 when it moves to its projected position as shown in FIG. 6.

In the modification shown in FIGS. 3, 6, and 7, the outer end of the retainer lug 60 terminates in a flat end face 59 at or with slight clearance inside the plane tangent to the two lobes 42 and 44 of the core body 40 so that it lies within a side groove 46 of the core. However, the cross-sectional area of that portion of the lug 60 which projects beyond the side surface of the figure-8 shaped core body is substantially increased over that of the prior art standard core. Also, such projecting portion has substantially greater support from the sleeve 50 and its rib 52 than in the prior art standard core, and its outer enlargement swings over a larger arc so that the enlarged lug is better positioned to receive support from adjacent solid portions of the core body. The modified core is adapted to be received in a standard core receptacle of the configuration shown in FIG. 2, where its enlarged lug fits in the same clearance space formed by milling flats at the sides of the core chamber, and the front end face 61 of the enlarged lug engages behind the core-retaining shoulder in such receptacle in the same manner as in the standard core but over a substantially larger area and with substantially greater strength, so as to greatly increase the pull resistance of the core.

To further enhance the grip with which the lug retains the core in its receptacle, the lug 60 may be formed with a notch 63 intermediate its ends so as to provide a second forward-presented face 65 axially spaced behind the front forward-presented face 61, as shown in FIGS. 3 and 10. Correspondingly, the receptacle may be formed with two rearward-presented shoulders for engagement by those two forward-presented faces 61 and 65 of the core-retaining lug. Such a receptacle is shown in FIGS. 10 and 11, and comprises a cylinder 70 of conventional external shape formed with a core chamber 72 of figure-8 cross section having a lower lobe 74 for the reception of the key plug lobe of a core as shown in FIGS. 3 and 7, and an upper lobe 76 for the reception of the upper lobe 44 of such core. The cross section of the core chamber is shown in FIG. 6, which may be considered to be a section taken on the line 6—6 of FIG. 10. The figure-8 -shaped cross section forms two ribs 78 at the sides of the chamber, and these are milled away over two spaced portions of their length to form flats 80 in the planes tangent to the sides of the two lobes of the chamber. The cutting of those flats through the side ribs 78 forms rearward-presented shoulders 82 and 84 at the sides of the chamber, with those at the left side in position to be engaged by the two forward-presented faces 61 and 65 on the core-retainer lug 60. FIG. 10 shows in section a portion of such lug 60 and its supporting sleeve rib 52, and shows the front end face 61 of the lug engaged against a front shoulder 82 and shows the second forward-presented end face 65 engaged against a rearward shoulder 84 formed in the side rib 78 of the core chamber. The core-retaining lug 60 is thus engaged with rearward-presented shoulders in the core receptacle at two axially spaced points so as to further increase the area of engagement of the lug with the receptacle. As noted, the core embodying the invention as shown in FIGS. 3–7 is adapted to be received in a standard core receptacle which would have a rearward-presented shoulder only at the forward end of the lug, corresponding to the rearward-presented shoulder 82 shown in FIGS. 10 and 11. While the second rearward-presented shoulder 84 would not be present, nevertheless, the enlarged lug 60 would be received in the standard core receptacle and would engage its core-retaining shoulder over a substantially larger area and with greater support and strength so as to provide substantially increased pull resistance. Even greater increased pull resistance results when the core is mounted in a core receptacle as shown in FIGS. 10 and 11 which includes not only a front rearward-presented shoulder 82, but also a second rearward-presented shoulder 84.

The core of FIGS. 3–11 may be manufactured and assembled in a manner similar to that for standard cores and cores as shown in application Ser. No. 048,531 so that its improvements can be obtained with little change from prior practices. The core body is modified in the important respect that a recess 64 is formed concurrently with cutting a side opening to accommodate the retaining lug. Also, the sleeve is modified in the important aspect that it has a lug 60 of much enlarged cross section. The recess 64 and side opening open through the rear face of the body so that the key plug 48 and the sleeve 50 with its wide top rib 52 and large lug 60 can be inserted from the rear. The retainer ring 74 is then inserted in the key plug groove and the face plate 76 applied by forcefully pressing it against the stud 79 on the core body. The pin tumbler barrels are desirably drilled after this assembly has been completed.

Operation and use of the improved core are also similar to that of the standard core. A control key 47 actuates the tumblers 55 to align shear faces therein at the control shear line, and not at the operating shear line, so that rotation of the key will rotate the key plug and sleeve further to retract and project the retaining lug 60. With the lug retracted, the core can be inserted or withdrawn from the receptacle 70. With the core in place, rotation of the key to normal position projects the retaining lug into engagement with the shoulders 82 and 84 to secure the core in the receptacle. The control key is then withdrawn and leaves the core in place and ready for operation by an operating key in the usual manner.

Figure 12:
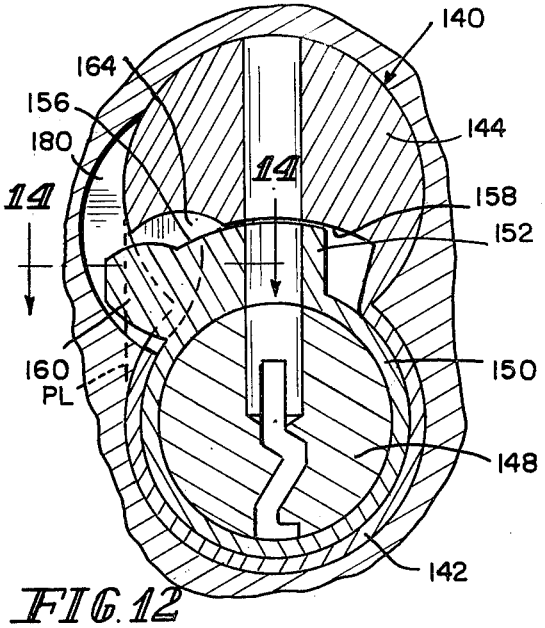
FIG. 12 is a vertical cross-sectional view, like FIG. 6, showing a modified embodiment of the invention in which a longer retaining lug projects beyond the plane tangent to the two lobes of the core body, and showing such lug in projected position.
Figure 13:
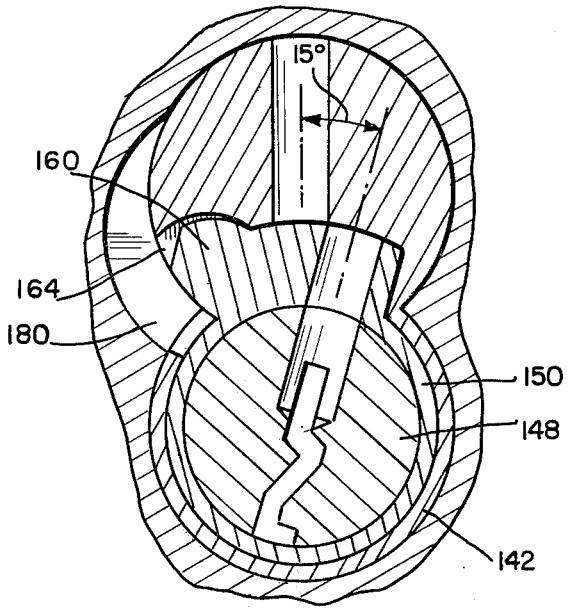
FIG. 13 is a section like FIG. 12, but showing the core-retaining lug in retracted position.
Figure 14:
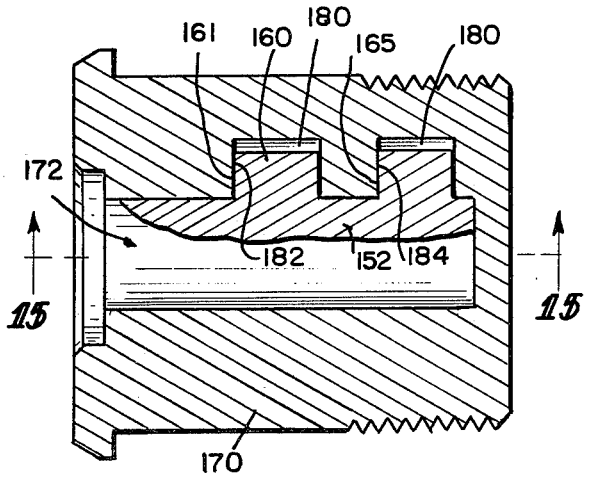
FIG. 14 is a horizontal section taken on the line 14—14 of FIG. 12, showing a lock cylinder formed with a core chamber in accordance with the present invention and including two deep recesses for the reception of the longer lug shown in FIGS. 12 and 13.
Figure 15:
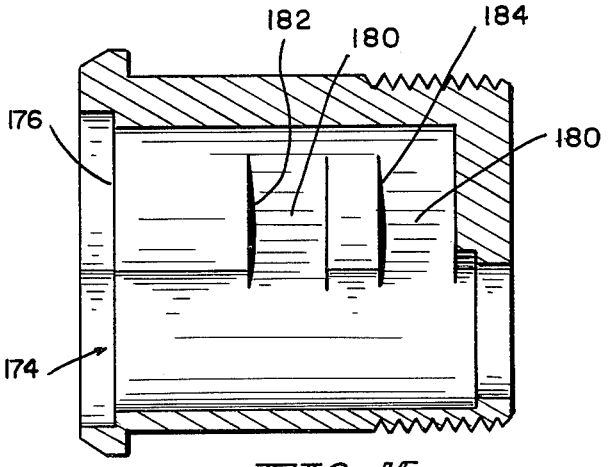
FIG. 15 is a vertical section taken on the line 15—15 of FIG. 14 and showing the two shoulders formed by the deep recesses.
Figure 16:
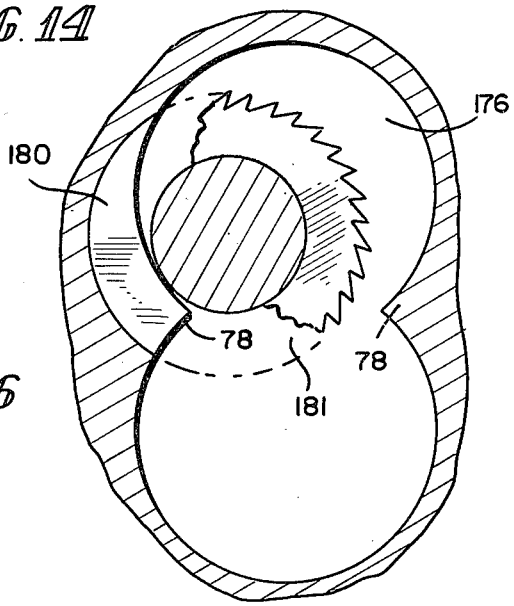
FIG. 16 is a diagrammatic view illustrating a method of cutting the deep recesses.
Figure 17:
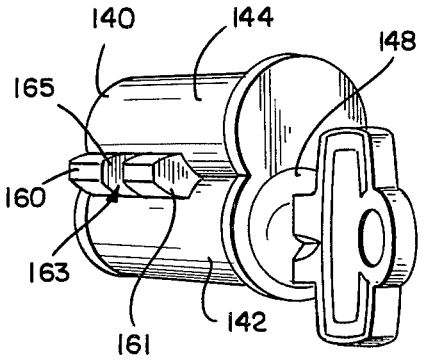
FIG. 17 is a perspective view similar to that of FIG. 4, but showing the longer core-retaining lug.

Even greater engagement of the retaining lug is provided by the modification shown in FIGS. 12–17. The core, as shown in perspective in FIG. 17, is of substantially the same construction as that of FIG. 3, except that the core-retaining lug 160 is substantially longer so as to project laterally from the core body 140 a greater distance. The core body comprises a lower lobe 142 containing a key plug surrounded by a sleeve 150 having a wide rib 152 at its top housed in a broached channel in the top lobe 144 defined by the cylindrical face 158. The thick longitudinal sleeve rib 152 carries core-retaining lug 60 similar to, but longer than, the lug 160 of FIGS. 3 and 6, and such lug has a notch 163 intermediate its length so as to comprise two lug segments having a first or front forward-presented end face 161 on the front segment and a second or rearward forward-presented end face 165 on the second segment. In this case, the segmented longer lug 160 projects beyond the plane PL tangent to the two lobes of the core body, as shown in FIG. 12, and the core receptacle is formed to accommodate such segmented longer lug. A lock cylinder 170 adapted to receive the core of FIGS. 12, 13, and 17 is shown in FIGS. 14 and 15. As in the cylinder of FIGS. 10 and 12, a core chamber 172 of figure-8 cross section is formed by lower and upper bores 174 and 176. As before, this basic chamber has side ribs 178. At one side, shown to the left in FIGS. 12, 13, and 16, the side wall of the chamber is cut to form two axially spaced recesses 180 which extend substantially beyond the plane tangent to the two lobes of the chamber. Such recesses form a front core-retaining shoulder 182 and a rear core-retaining shoulder 184, behind which the two segments of the lug 160 will be engaged with their forward-presented faces 161 and 165 in core-retaining engagement with the rearward-presented faces of such shoulders.

As indicated in FIG. 16, the two recesses 180 may be cut with a circular milling cutter 181 of a size adapted to pass through the upper lobe 176 of the core chamber. Such cutter is inserted in the core chamber to a suitable depth, and it is then moved laterally to the position shown in FIG. 16 so as to cut a recess 180 as shown.

In this modification of FIGS. 12–17, the core-retaining lug 160 is both substantially thicker and substantially longer than the lug 30 of the prior art standard core, its radially outer end swings on a larger radius, its cross-sectional area of engagement with each of the receptacle shoulders 182 and 148 is very much greater than that of the lug 30 in the prior art standard core, and its enlargement is positioned for support from adjacent solid material of the core body. In this modification, as in that of FIGS. 6–9, the upper lobe of the core is formed with a recess 164, desirably of the same size and formed in the same manner as illustrated in FIGS. 8 and 9, namely, by a plunge cut of an end milling cutter 67 which both cuts through the side wall of the core body 140 and forms the recess 164 outward from the geometric control shear cylinder and the arc of the inner face 158 of the top lobe 144. The thus-formed recess 164 opens both radially inward toward the axis of rotation of the sleeve and laterally outward through the side wall of the core body. The sleeve is rotatable between a lug-projected position shown in FIG. 12 to a lug-retracted position shown in FIG. 13, through the standard angle of 15°. In retracted position, the enlarged and elongated lug 160 lies wholly within the profile of the core body 140, with its enlarged upper portion in the recess 164, so as to permit the core to be inserted and removed axially of the chamber 172.

The modified core receptacle shown in FIGS. 18 and 19 is adapted to receive a core as shown in FIG. 22. The core is the same as that shown in FIG. 17, except that its core-retaining lug 260 is of continuous full length and unsegmented, without a notch between its ends, so that it has only a single forward-presented end face 261. The core body 240 is of figure-8 cross section as before, and is adapted to be received in a core chamber 272 of corresponding figure-8 shape formed in the cylinder 270. In this case, a rearward-presented shoulder 282 is formed in the cylinder 270 by boring a circular, flat-ended hole 280 from the rear of the cylinder 270 to a depth adapted to locate the bottom face of the hole as a shoulder 282 in position to be engaged from behind by the end face 261 of the retaining lug 260. This is shown in FIG. 18, in which a fragmental portion of the lug 260 and its supporting sleeve rib is shown in section in the core chamber, with the forward end face 261 of the lug 260 engaged with the shoulder 282 at the bottom of the hole 280. The position of the hole 280 relative to the core chamber is shown in the rear elevational view of FIG. 20.

A further modification shown in FIG. 21 comprises a lock cylinder 370 in which a front rearward-presented core-retaining shoulder 382 is provided by forming a flat 380 in position to receive the forward segment of a lug 360 of short length corresponding to the forward segment of the lug 60 in FIGS. 3, 6, 7, and 10, and having a front forward-presented end face 361 in engagement with such rearward-presented shoulder 382. A second rearward-presented shoulder 384 is formed by drilling a hole 480 in the cylinder 370 from the rear to a depth such that the flat bottom of such hole provides the desired rearward-presented shoulder 384. For engagement with such shoulder, the core-retaining lug 360 has an enlarged and elongated rear segment 460 corresponding to the rear portion of the lug 160 shown in FIGS. 12–17, such lug having a forward-presented face 461 which engages behind the rearward-presented shoulder 384.

The modified cores of FIGS. 12–22 may be manufactured, assembled, and used in the same manner as that of FIGS. 3–11. Each core in accordance with the present invention provides substantially greater pull resistance and hence greater security than the prior standard core, and does so with minimum change in manufacturing practices and without substantial change in the manner of installation and use. While some modifications require different receptacles, the core of FIGS. 3–11 is usable in the many installations of standard receptacles to give higher pull resistance in those installations.

What is claimed is:

1. A key-removable lock core having increased pull resistance, comprising a core body of figure-8 cross section and having a key plug lobe formed with an axial bore therethrough, and a parallel pin tumbler lobe, a key plug rotatable on an axis in the key plug lobe, a control sleeve inserted axially in said bore and having a cylindrical interface with said key plug defining an operating shear line between the key plug and sleeve, said sleeve including a wide rib extending longitudinally substantially the fully length of the key plug and said pin tumbler lobe having a wide recess in which such rib is movable through a limited angle about the axis of said bore, the outer face of said rib and the inner face of said recess defining a control shear line therebetween, a series of pin tumbler barrels in said pin tumbler lobe and extending into the key plug, substantially all of which barrels extend across both said shear lines and through said wide rib so that the core can be combinated at substantially all of said barrels at the control shear line, said rib-receiving recess having side walls interconnecting the two lobes of the core body over a portion of the length of the body and the one side wall having an opening therethrough over a rear end portion of the core body and the rib having a retaining lug portion movable in said opening between a projected position in which it will engage behind a shoulder of a core receptacle to retain the core therein and a retracted position in which it releases the core for removal from such receptacle, and including the improvement comprising an enlargement recess in the pin tumbler lobe of the core body extending forward from the rear end of the body and adjoining said side wall opening, and an enlargement on said retaining lug extending radially of said sleeve beyond the face thereof which defines said control shear line, said lug enlargement serving to increase the cross-sectional area of said retaining lug and being movable with such lug between a retracted position within said enlargement recess in the pin tumbler lobe and a projected position in which it provides an enlarged cross section on the retaining lug for engagement behind a shoulder of the core receptacle.

2. A key-removable core as in claim 1 in which said key plug has a rear flange fixed thereto and in forward pull-transmitting relation with said control sleeve so as to transmit directly to said sleeve and its enlarged retaining lug, pull exerted on the key plug.

3. A key-removable core as in claim 2 in which said rear flange is integral with the key plug.

4. A key-removable core as in claim 1 in which said enlargement recess is in the form of a segment of a cylindrical bore extending forward from the rear of the core body.

5. A key-removable core as in claim 1 or 2 in which the two lobes of the core body define a longitudinal side groove in such body, and the enlarged lug, in projected position, extends into such groove and terminates at or inside the plane tangent to the two lobes of the core body so that the core is receivable in a core chamber of complementary cross-sectional shape having a lug-receiving space defined by the plane tangent to the two lobes thereof.

6. A key-removable core as in claim 1 or 4 in which the two lobes of the core body define a longitudinal side groove in such body, and the enlarged lug, in projected position, extends into such groove and therebeyond past the plane tangent to the two lobes of the core body.

7. A key-removable core as in claim 1 in which the enlarged lug has a forward-presented core-retaining face at its forward end for engagement behind a rearward-facing shoulder in a core receptacle.

8. A key-removable core as in claim 1 or 4 in which the enlarged lug includes a plurality of segments and has a forward-presented core-retaining face on at least two of such segments.

9. A key-removable core as in claim 4 in which said enlargement has a generally cylindrical face complementary to the cylindrical face of said recess.

10. A key-removable core as in claim 1 in which the lug enlargement, in retracted position, bears as a stop against the face of the enlargement recess.

11. A key-removable core as in claim 1 in which the two lobes of said core body are cylindrical and in parallel intersection relation so as to form a body of figure-8 cross section with V-shaped grooves at the two sides thereof, and the enlarged lug projects from the body in one of said grooves and extends substantially to the plane tangent to the said lobes.

12. A lock mechanism, comprising a key-removable core as in claim 11 in combination with a core receptacle having a core-receiving chamber of figure-8 cross-sectional shape formed by a pair of parallel intersecting bores and defining inner longitudinal ribs at the opposite sides thereof, one of said inner ribs being cut away over part of its length to form a flat side substantially in the plane tangent to the two bores so as to provide clearance space for the projected core-retaining enlarged lug and to form a rearward-facing shoulder on inner rib for engagement by such lug, the enlarged lug having an area of engagement with such shoulder which lies outward of a cylinder defined by the control shear line of the core to thereby increase the resistance of the core against forceful pulling from the receptacle.

13. A lock mechanism, comprising a key-removable core as in claim 11 in combination with a core receptacle having a core-receiving chamber of figure-8 cross-sectional shape formed by a pair of parallel intersecting bores, a recess in the side wall of said chamber, extending beyond the plane tangent to said bores, and having a rearward-presented core-retaining shoulder at its end, the core-retaining enlarged lug of the core, in projected position, extending into said receptacle recess and engaged behind said shoulder over an area extending beyond said plane so as to provide increased resistance of the core against forceful pulling from the receptacle.

14. A lock mechanism as in claim 13 in which said receptacle recess is formed by a bore extending axially from the rear of the receptacle and having a flat end face forming said shoulder.

15. A lock mechanism as in claim 13 in which said receptacle recess is cut into the side wall of the chamber from inside the chamber.

16. A lock mechanism as in claim 13 in which the core-retaining lug is formed with two axially spaced segments, and the receptacle is formed with two correspondingly spaced recesses.

17. A lock mechanism as in claim 16 in which the rearward one of said two receptacle recesses is formed by a bore extending axially from the rear of the receptacle and having a flat end face forming a rearward-presented shoulder for engagement by the rearward one of said lug segments.

18. A lock mechanism, comprising a key-removable core as in claim 1 in combination with a core receptacle having a core-receiving chamber, the core-retaining enlarged lug having front and rear segments each with a forward-presented face at its front end, said chamber being recessed to provide clearance for said lug when projected from the core and to define two rearward-presented shoulders for core-retaining engagement by said forward-presented end faces of the front and rear segments.

19. A lock mechanism as in claim 18 in which said chamber has a rear lug-receiving recess formed by an axial bore from the rear of the receptacle, the end face of which bore forms one of said rearward presented shoulders.

20. A lock mechanism as in claim 18 or 19 in which said lug segments are axially spaced and the chamber is formed with correspondingly spaced lug-receiving recesses.

21. A key-removable core, comprising a core body having a key plug lobe and a pin tumbler lobe, a key plug rotatable on an axis in the key plug lobe, a control sleeve surrounding the key plug and mounted for limited rotation with respect to said key plug lobe, said sleeve including a wide longitudinal rib, a series of pin tumbler barrels in said pin tumbler lobe, all of which extend through said sleeve rib and into the key plug, said sleeve and rib having an inner cylindrical surface in shear relationship with the surface of the key plug and defining an operating shear line across said barrels and a geometric operating shear cylinder, said rib having an outer cylindrical surface in shear relation with a cylindrical surface on the pin tumbler lobe and defining a control shear line across said barrels and a geometric control shear cylinder, said core body having an opening in the side thereof and extending forward from the rear of the body over part of the length thereof, said opening having a portion between said two shear cylinders and a portion extending beyond said control shear cylinder into the pin tumbler lobe of the body, there being an enlargement recess formed in such pin tumbler lobe, such recess opening outward to form part of said side opening and opening through said control shear cylinder toward the axis of the sleeve, a core-retaining lug on said sleeve and disposed in said side opening and extending from said sleeve rib circumferentially of said sleeve between said two shear cylinders, and extending radially outward of said control shear cylinder so as to include a portion which, in the retracted position of the sleeve, lies in said enlargement recess, and which, in the projected position of the lug, is adapted to engage a retaining shoulder over an area outside said control shear cylinder, said sleeve having a normal position in which said lug projects through said side opening and beyond the profile of the core body for retaining the core in a core receptacle and being movable to a retracted position in which said lug lies within such profile to permit insertion and removal of the core with respect to a core receptacle.

22. A key-removable core as in claim 21 in which said core body is of figure-8 cross section, and said lug, in projected position, terminates at or inside the plane tangent to the two lobes of the core body.

23. A key-removable core as in claim 21 in which said core body is of figure-8 cross section, and said lug, in projected position, extends beyond the plane tangent to the two lobes of the core.

* * * * *

UNITED STATES PATENT AND TRADEMARK OFFICE

CERTIFICATE OF CORRECTION

PATENT NO. : 4,444,034

DATED : April 24, 1984

INVENTOR(S) : Walter E. Best and William R. Foshee

It is certified that error appears in the above-identified patent and that said Letters Patent is hereby corrected as shown below:

Column 8, line 53, change "retaining lug 60" to --retaining lug 160-- and change "the lug 160" to --the lug 60--.

Column 10, line 52 (claim 1), change "body and the one" to --body, one--.

Column 11, line 40 (claim 9), before "enlargement", insert --lug--.

Column 11, line 47 (claim 11), change "intersection" to --intersecting--.

Signed and Sealed this

*Nineteenth* Day of *February 1985*

[SEAL]

*Attest:*

DONALD J. QUIGG

*Attesting Officer*

*Acting Commissioner of Patents and Trademarks*